US006270076B1

(12) United States Patent
Reist

(10) Patent No.: US 6,270,076 B1
(45) Date of Patent: Aug. 7, 2001

(54) CONVEYING SYSTEM

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/229,190

(22) Filed: Jan. 13, 1999

Related U.S. Application Data

(63) Continuation of application No. PCT/CH97/00200, filed on May 22, 1997.

(30) Foreign Application Priority Data

Jul. 19, 1996 (CH) ..... 1816/96

(51) Int. Cl.[7] ..... B65H 39/10
(52) U.S. Cl. ..... 271/302; 271/204; 271/84
(58) Field of Search ..... 271/302, 204, 271/85; 198/465.4, 687.1

(56) References Cited

U.S. PATENT DOCUMENTS

| | | | |
|---|---|---|---|
| 3,032,341 | 5/1962 | Reist | 271/79 |
| 3,123,888 | 3/1964 | Meyers | 28/1 |
| 4,039,182 | 8/1977 | Reist et al. | 271/64 |
| 4,438,618 | 3/1984 | Honegger | 53/430 |
| 4,866,910 | 9/1989 | Reist | 53/430 |
| 4,887,809 | 12/1989 | Eberle | 271/203 |
| 4,917,369 * | 4/1990 | Moll et al. | 198/465.4 X |
| 5,007,624 | 4/1991 | Chandhoke | 270/52 |
| 5,503,264 | 4/1996 | Eberle | 198/803.01 |
| 5,755,436 * | 5/1998 | Reist | 271/204 |
| 6,003,859 * | 12/1999 | Reist | 271/204 |

FOREIGN PATENT DOCUMENTS

| | | | |
|---|---|---|---|
| 3801056 * | 7/1989 | (DE) | 198/465.4 |

* cited by examiner

*Primary Examiner*—David H. Bollinger
(74) *Attorney, Agent, or Firm*—F. David AuBuchon; Brinks Hofer Gilson & Lione

(57) ABSTRACT

The conveyor line (1) of a conveyor has a branching point (6) with a switch (7). This switch has a pivotable switching member (8) which in one position lies in this conveyor line (1) and in the other position connects this first conveyor line (1) with a second conveyor line (10). Preceding the branching point (6) is a retaining member (11) that can be inserted into the path of movement of the transport elements (2) conveyed along the conveyor line (1). This retaining member (11) can be used to hold back the transport elements (2) approaching the branching point in order to create room for changing over the switching member (8). The transport elements are independent of one another, which makes it possible, selectively and as required, either to move the oncoming transport elements (2) along the first conveyor line (1) or to divert them into the second conveyor line (10).

25 Claims, 6 Drawing Sheets

CONVEYING SYSTEM

This application is a continuation of PCT/CH97/00200 filed May 22, 1997.

BACKGROUND OF THE INVENTION

The present invention relates to a conveying system for conveying articles comprising at least one conveying path.

A conveying system of this type is known from CH-A-382 768 (and the corresponding U.S. Pat. No. 3,032,341), in the case of which the transporting elements are forced along a closed conveying path by conveying means and are moved along downwardly sloping sections by gravitational force. Arranged along this closed conveying path is a charging station, for charging the transporting elements with printed products, and a discharge location, at which the transporting elements discharge the printed products again. The transporting elements which have been relieved of load are sent back to the charging location again. The document mentioned also describes an embodiment in which, after the charging station, the conveying path is divided up into two lines, of which each leads to a discharge location. The transporting elements are directed alternately to one of the two lines. As a result, the discharge locations are each fed half of the printed products received by the transporting elements at the charging location. Each discharge location and the processing station assigned thereto can thus be operated at a correspondingly lower speed.

SUMMARY OF THE INVENTION

The object of the present invention, then, is to provide a conveying system of the type mentioned in the introduction which can be used more diversely than the abovementioned conveying system of the prior art.

This object is achieved according to the invention by a conveying system having the features of a conveying system for conveying articles, comprising: at least one conveying path; a number of individual transporting elements for transporting articles, said transporting elements being independent from one another and movable along said conveying path; at least one controllable branching location or at least one controllable introduction location arranged on the conveying path; diverting means at said branching location for diverting out of the conveying path individual transporting elements which are empty or are transporting articles; and introducing means at said introduction location for introducing into the conveying path individual transporting elements which are empty or are transporting articles.

At the branching location and the introduction location, it is possible for both empty transporting elements and transporting elements which are transporting articles to be ejected out of the conveying path, or introduced into the same, individually or in groups. This makes it possible for the number and sequence of the transporting elements moved along the conveying path to be influenced, by straightforward means, in accordance with requirements. This is important, in particular, when transporting elements which are transporting articles have undesired empty transporting elements between them or when the transporting elements are transporting the same kind of articles, or different kinds of articles, which are not all intended for the same destination.

Preferred developments of the conveying system according to the invention form the subject matter of the dependent claims.

BRIEF DESCRIPTION OF THE DRAWINGS

Exemplary embodiments of the subject matter of the invention are explained in more detail hereinbelow with reference to the drawing, in which, purely schematically.

DETAILED DESCRIPTION OF THE PREFERRED EMBODIMENTS

Figure 1:
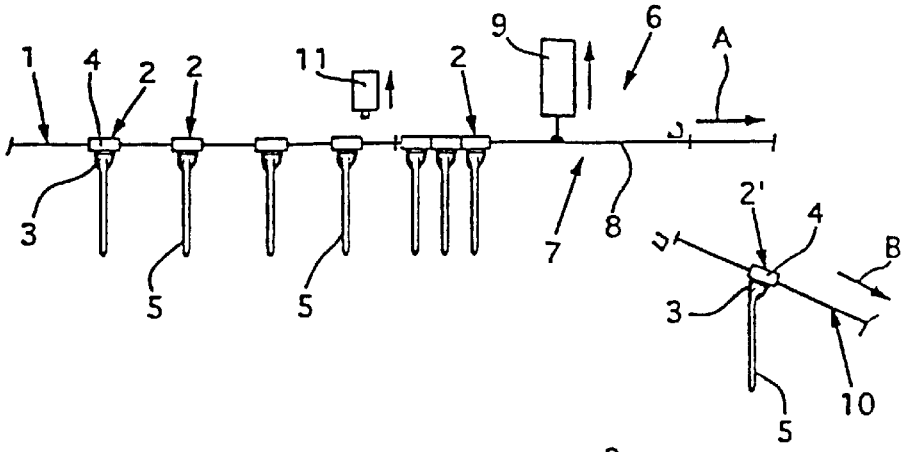
FIGS. 1 and 2 show a section of a conveying path with a branching location and a diverter, which is arranged on the same, in two switching positions.
Figure 2:
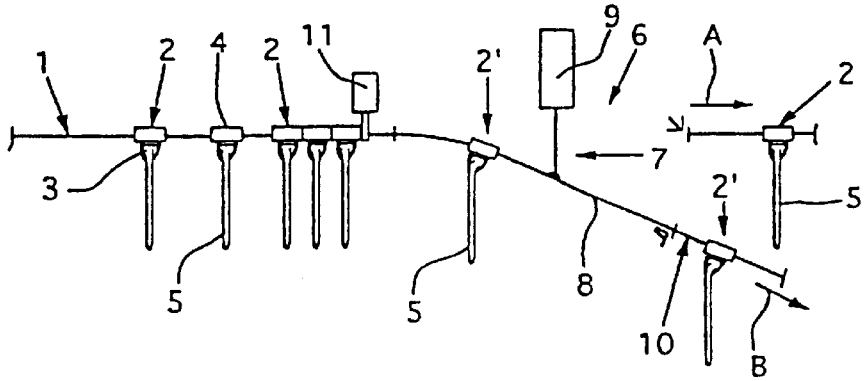

FIGS. 1 and 2 show a section of a first conveying path 1 (also referred to as main conveying path hereinbelow) along which transporting elements 2 (only illustrated schematically) move in the direction of the arrow A. The transporting elements 2 are separate from one another, i.e. are not coupled to one another, and are thus independent of one another. In all the exemplary embodiments shown in the figures, the transporting elements 2 have controllable grippers 3, which are fastened on carriages or slides 4. The grippers 3 retain articles 5, which in the exemplary embodiments shown are printed products, in particular newspapers, periodicals, brochures and the like, as well as supplements for such printed products. In the exemplary embodiment according to FIGS. 1 and 2, said articles 5 are transported in a hanging position.

A branching location 6 with a diverter 7 is arranged on the main conveying path 1. Said diverter has a pivotable diverter element 8, which can be switched over between two positions by means of an actuating element 9. A second conveying path 10, which is also referred to as branch conveying path hereinbelow, leads away from the branching location 6. Arranged upstream of the branching location 6, as seen in the conveying direction A, is a switchover restraining element 11 which can be displaced into the movement path of the transporting elements 2, which run up to the branching location 6 in the direction of the arrow A, in order to stop said transporting elements.

In FIG. 1, the diverter element 8 assumes a position in which it is located in the main conveying path 1. The transporting elements 2 thus move along said main conveying path. If, then, the transporting elements 2 are to be directed to the branch conveying path 10, then the restraining element 11 is actuated and the incoming transporting elements 2 are stopped. As soon as the diverter element 8 is free of transporting elements 2, it is switched over into the other position, shown in FIG. 2, by means of the actuating element 9. The restraining element 11 is then disengaged and releases the transporting elements 2 so that they can move on. The transporting elements designated by 2' then move in the direction of the arrow B along the branch conveying path 10.

As soon as the desired number of transporting elements 2' have been directed to the branch conveying path 10, the restraining element 11 is actuated, which results in the incoming transporting elements 2 being stopped again (FIG. 2). As soon as the diverter element 8 is free, it is switched over again. After the following disengagement of the restraining element 11, the transporting elements 2 are released so that they can move further along the main conveying path 1 (see FIG. 1).

The manner in which the transporting elements 2 are moved along the conveying paths 1 and 10 is not illustrated specifically in FIGS. 1 and 2. For this purpose, use can be made of suitable transporting means or—as is illustrated with reference to the downwardly sloping branch conveying path 10—of gravitational force.

Figure 3:
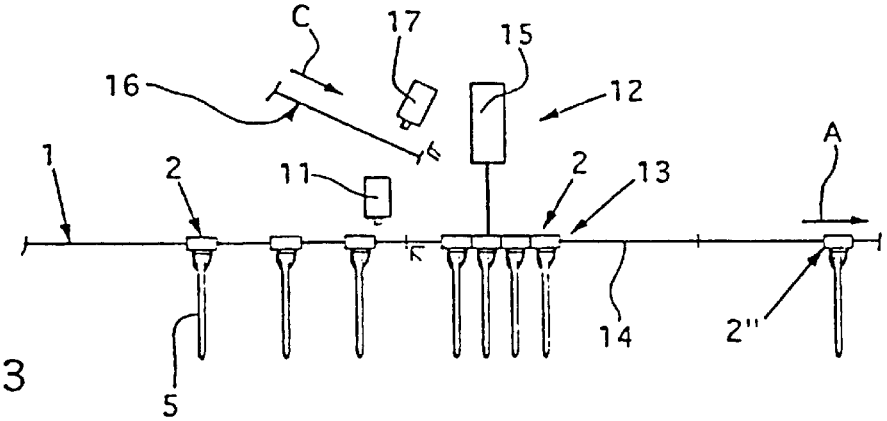
FIGS. 3 and 4 show a section of a conveying path with an introduction location and a diverter, which is arranged on the same, in two switching positions.
Figure 4:
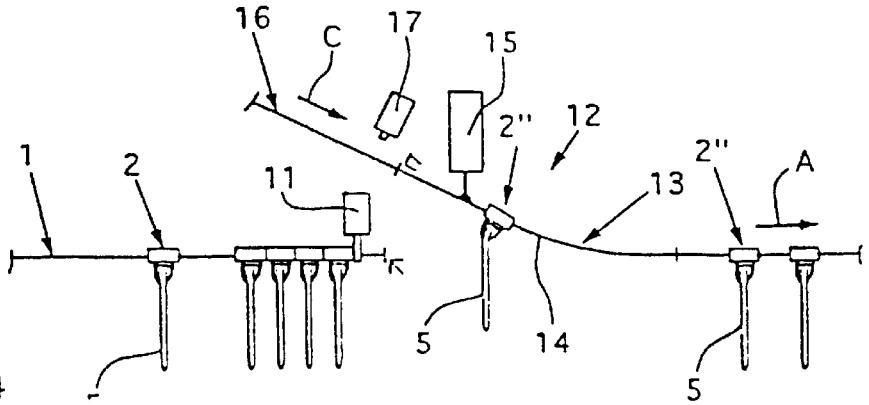

FIGS. 3 and 4 show, in an illustration corresponding to FIGS. 1 and 2, an embodiment in which an introduction location 12 is arranged on the first conveying path 1 (main conveying path). A diverter 13 with a pivotable diverter element 14 is likewise provided at this introduction location 12. An actuating element 15 serves for switching over the diverter element 14.

Leading to the introduction location 12 is a second conveying path 16 (feed path), on which there is arranged a controllable restraining element 17 which is arranged upstream of the introduction location 12, as seen in the conveying direction C of the second conveying path 16.

In the illustration according to FIG. 3, the diverter element 14 is located in the main conveying path 1. The transporting elements 2 thus move in the direction of the arrow A along the main conveying path 1. If, then, transporting elements 2 are to be introduced into the first conveying path 1, then the restraining element 11 is actuated and is thus moved into the movement path of the transporting elements 2 fed along the first conveying path 1, as a result of which said transporting elements 2 are prevented from moving further. As soon as there are no longer any transporting elements 2 along the diverter element 14, the diverter element 14 is switched over into the other position be means of the actuating element 15 (FIG. 4). The transporting elements 2", fed via the feed path 16, then pass into the main conveying path 1 via the diverter element 14 and are moved further along said path in the direction of the arrow A, as can be seen from FIG. 4. Actuation of the restraining element 17 moves the latter into the movement path of the transporting elements 2", which run up along the feed path 16. As a result, the transporting elements 2" are stopped. The diverter element 14 can then be switched over. By virtue of the restraining element 11 being moved out of the movement path of the transporting elements 2, the latter are released so that they can move further along the main conveying path 1 (FIG. 3).

The articles 5 which are directed along the feed path 16 to the introduction location 12 by the transporting elements 2" may be of the same type as the articles 5 which pass to the introduction location 12 via the main conveying path 1, or else they may be of some other type. In the latter case, it is thus possible, using the embodiment shown in FIGS. 3 and 4, for articles 5 of different types to be mixed together in any desired, variable ratio.

Figure 5:
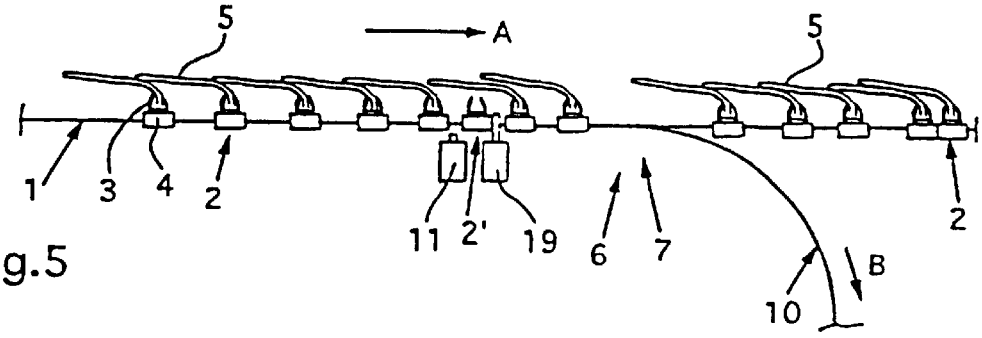
FIGS. 5–7 show a section of a further embodiment of a conveying path with a branching location for ejecting empty transporting elements, in different operating states.
Figure 6:
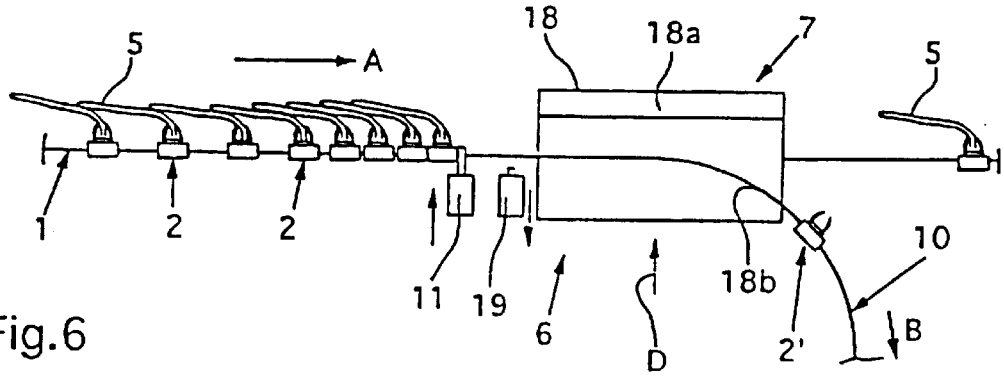
Figure 7:
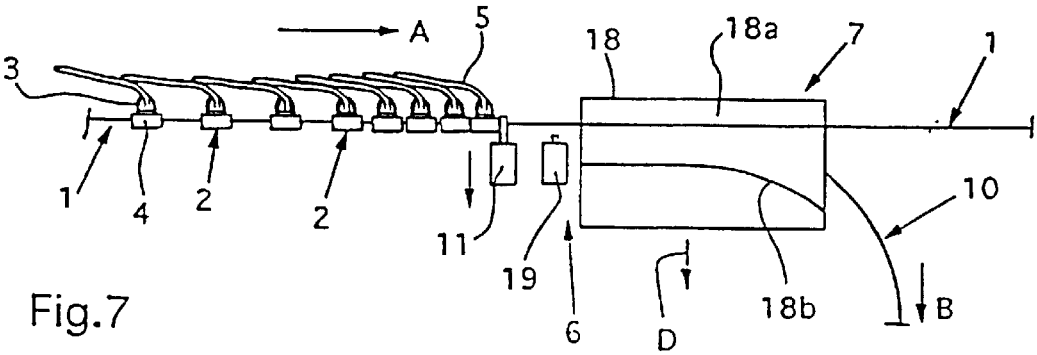

FIGS. 5–7 show a variant of the embodiment according to FIGS. 1 and 2, and this variant differs from the solution shown in FIGS. 1 and 2, in particular, by the diverter 7 being of a different configuration. Furthermore, in the embodiment according to FIGS. 5–7, the articles 5 are transported in the manner of an imbricated formation rather than in a hanging position.

As FIGS. 6 and 7 show, the diverter 7 has a diverter element 18 which can be displaced in a translatory manner in the direction of the arrow D. Said diverter element has two path sections **18*a* and 18*b*, of which that path section 18*a* is assigned to the main conveying path 1 and, accordingly, runs in a rectilinear manner. The other path section 18*b* is curved so as to follow the curvature of the second conveying path 10. It should be mentioned that, if the two path sections 18*a*, 18*b*** are arranged correspondingly, it is also possible for the diverter to be designed such that it can be moved in a direction at right angles to the plane of the drawing.

The embodiment according to FIGS. 5–7 functions in basically the same way as has been explained with reference to FIGS. 1 and 2. In the position of the diverter element 18 which is shown in FIG. 7, the path section **18*a* of the diverter element is located along the route of the first conveying path 1. In the position, which is shown in FIG. 6 the second path section 18*b* of the diverter element 18 connects the main conveying path 1 to the branch conveying path 10**.

It is also shown with reference to FIGS. 5–7 how individual empty transporting elements 2' can be ejected out of the stream of transporting elements 2 provided with articles 5. For this purpose, a second restraining element 19 is provided alongside the restraining element 11, said second restraining element also being arranged upstream of the branching location 16 [sic], but downstream of the first restraining element 11, as seen in the conveying direction A. As soon as a detector arrangement (not illustrated) establishes that an empty transporting element 2' is running up to the branching location 6, the second restraining element 19 is moved into the movement path of the transporting elements 2 at the correct point in time, with result that the empty transporting element 2' is prevented from moving further (FIG. 5). The first restraining element 11 is then moved in downstream of said empty transporting element 2', the first restraining element stopping the following transporting elements 2 which are transporting articles 5. As soon as the diverter element 18 is free, it is switched over. The second restraining element 19 is then moved out and the empty transporting element 2' is released so that it can move further. This empty transporting element 2' is then guided away via the branch conveying path 10, as FIG. 6 shows. The diverter element 18 is moved back again, whereupon the first restraining element 11 is also disengaged again, and the movement of the transporting elements 2 with the transported articles 5 is thus released (FIG. 7).

Figure 8:
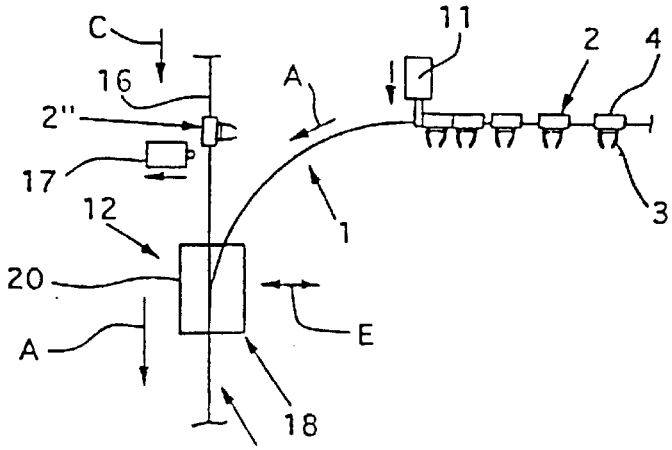
FIG. 8 shows a section of a further embodiment of a conveying path with an introduction location.

FIG. 8 shows, in an illustration corresponding to FIGS. 3 and 4, how empty transporting elements 2", which are fed along the conveying path 16, can be introduced between empty transporting elements 2 which move along the main conveying path 1 to the introduction location 12. The functioning is the same here as has already been described with reference to FIGS. 3 and 4. However, FIG. 8 shows a diverter element 20 which is of the same design as the diverter element 18 of the exemplary embodiment according to FIGS. 5–7 and is moved, in the direction of the arrow E, in a translatory manner between two positions.

Figure 9:
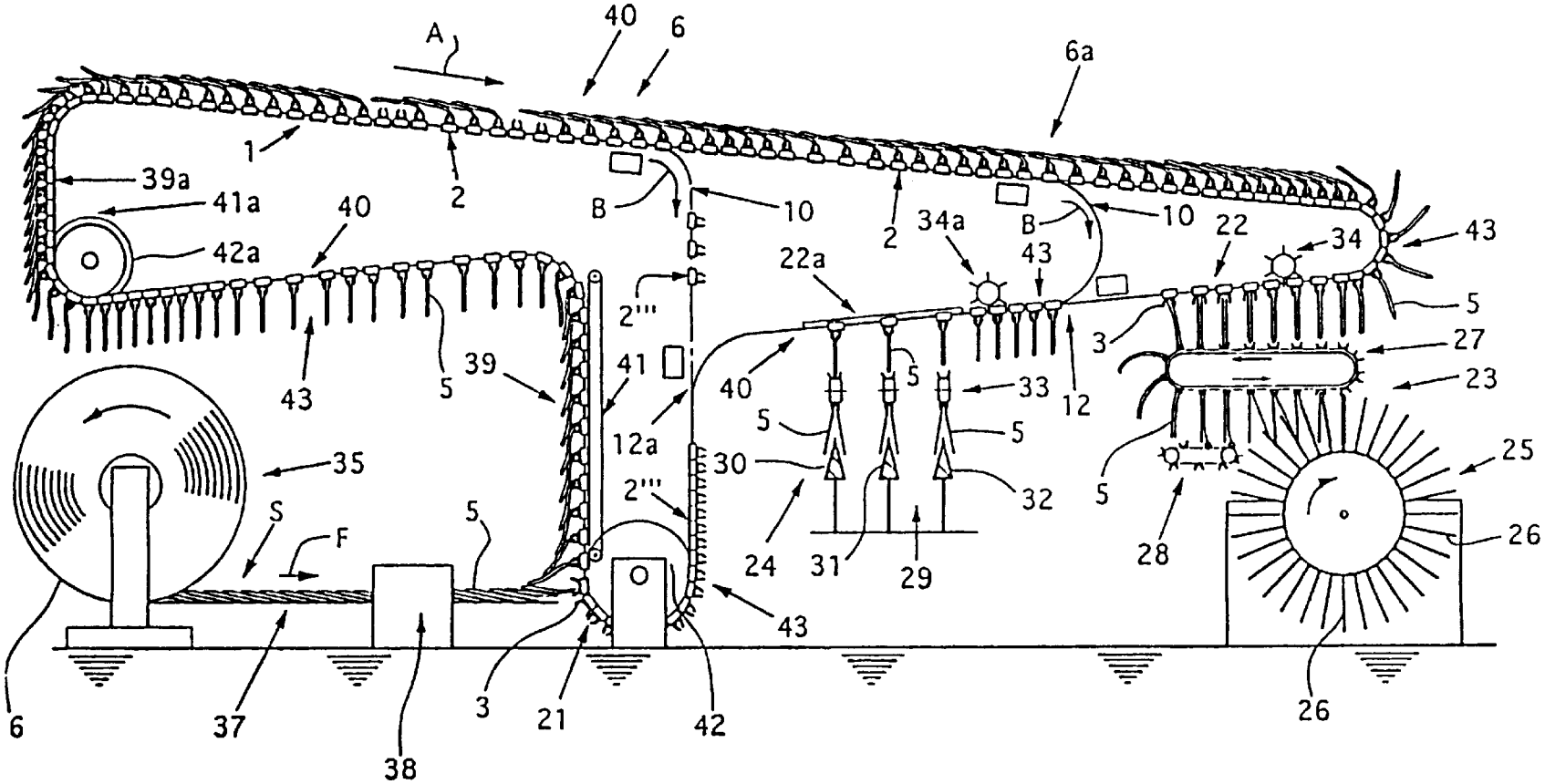
FIG. 9 shows a conveying system with a main conveying path which is designed as a closed loop and has branching and introduction locations as well as a charging location and discharge locations.

FIG. 9 shows a conveying system in which the first conveying path or main conveying path 1 is designed as a closed loop and has branching locations 6, **6*a* and introduction locations 12, 12*a*, as has been explained with reference to FIGS. 1–8. This conveying system also has the charging location 21 and discharge locations 22 and 22*a*, which are arranged on the main conveying path 1. Each discharge location 22, 22*a* is respectively assigned a processing station 23, 24**.

The processing station 23 contains a collection drum 25 (only illustrated schematically) of known design. This collecting drum 25 has saddle-like bearing elements 26 which rotate in the clockwise direction and on which the articles 5, which in the present case are designed as folded printed sheets, are positioned in a straddling manner. The processing station 23 also contains a receiving device 27 and an opening device 28. The receiving device 27 grips the printed sheets 5, which pass to the discharge location 22 in a hanging position, at their bottom, exposed edge, which in the present case is the folded edge. After the printed sheets 5 have been gripped by the receiving device 27, the grippers 3 of the transporting elements 2 release the printed sheets 5, which are deflected by the receiving device 27, with result that the open side edges come to be located at the bottom and pass into the region of the opening device 28, which opens the printed sheets 5 in a manner which is not illustrated specifically but is known per se, i.e. lifts the two printed-sheet halves off from one another. The open printed sheets are then guided to the collecting drum 25 by the receiving device 27 and positioned on the bearing elements 26. The printed sheets 5 pass from the main conveying path 1 to the processing station 23 in the manner of a clamp-to-clamp transfer.

The other processing station 24 contains a collecting device which is designated by 29 and has three collecting paths 30, 31, 32 which are arranged one beside the other in a stationary manner. Arranged above these collecting paths 30, 31, 32 is an opening device 33 which opens the folded printed sheets 5 which has been discharged at the discharge location 22*a* and positions them on the collecting paths 30, 31 and 32 in a straddling manner.

It goes without saying that devices other than those shown for processing the articles 5 which have been discharged at the discharge locations 22 and 22*a* may be provided at the processing stations 23 and 24.

Arranged upstream of each discharge location 22, 22*a* is a respective timing device 34, 34*a* (likewise only illustrated schematically) which ensures that the transporting elements 2 pass to the discharge location 22 or 22*a* in a specific timed sequence, in order to ensure satisfactory transfer to the devices of the processing stations 23 and 24.

The articles 5 transported by the transporting elements 2, these articles 5, as has already been mentioned, being folded printed sheets in the present case, are delivered from a source which, in the exemplary embodiment according to FIG. 9, is a product roll 36 mounted rotatably in an unwinding station 35. By virtue of the product roll 36 being rotated in the counterclockwise direction, the printed sheets 5 are unwound from the product roll 36 and guided, in the form of an imbricated formation S, in the direction of the arrow F to the charging location 21 by means of a feed conveyor 37. In this imbricated formation S, each printed product 5 rests on the following printed product in each case, the trailing edge of the printed products 5 being the folded edge. Before the printed products 5 pass to the charging location 21, they run through an evening-out device 38 (not illustrated specifically) in which it is ensured in a manner known per se that the printed products 5 are at a uniform spacing from one another.

At the charging location 21, each printed product 5 is gripped by the clamp 3 of a transporting element 2 and transported away.

The main conveying path 1 has upwardly sloping sections 39, 39*a* and downwardly sloping sections 40 which alternate with one another. The transporting elements 2 move along the downwardly sloping sections 40 under the action of gravitational force. If appropriate, it is, of course, also possible for suitable conveying means to be provided. In order to move the transporting elements 2 along the upwardly sloping sections 39 and 39*a*, conveying means 41 are provided, or it is possible for conveying means 39*a* [sic] of a similar design to be provided, these not being illustrated specifically in FIG. 9. In order to transfer the transporting elements 2 from a downwardly sloping path 40 into an upwardly sloping section 39, 39*a*, deflection wheels 42 and 42*a* are provided, these likewise having a conveying action. This conveying action may be sufficient in the case of short upwardly sloping sections, as is indicated in the case of the section 39*a*.

Those sections of the conveying path 1 which are arranged upstream of the timing devices 34 and 34*a* and deflection wheels 42, 42*a* serve as accumulation or storage sections 43 in which the transporting elements can be stored. This ensures that there is no interruption as the transporting elements 2 are fed to the discharge locations 22, 22*a* by means of the timing devices 34, 34*a* and to the conveying means 41*a* 41*a*.

With reference to the embodiment according to FIG. 9, which is to be taken as a possible example of a conveying system according to the invention, it is possible to show the possibilities obtained as a result of the independence of the transporting elements 2 from one another and the provision of at least one branching location 6, 6*a* and/or at least one introduction location 12, 12*a* along the conveying path 1. Thus, it is possible for empty transporting elements 2''' to be ejected out of the conveying path 1 at the branching location 6, as has been explained with reference to FIGS. 5–7. The ejected transporting elements 2''' can then be introduced into the main conveying path 1 again at the introduction location 12*a*, as FIG. 8 shows. Via the branching location 6*a*, it is possible for the transporting elements 2 which are transporting printed sheets 5 to be directed optionally to the discharge location 22 or to the discharge location 22*a*, as has been explained with reference to FIGS. 1 and 2 and 5–7. The transporting elements 2 which were to be directed to the discharge location 22*a* are introduced into the main conveying path 1 again at the introduction location 12, as has already been shown with reference to FIGS. 3 and 4.

Figure 10:
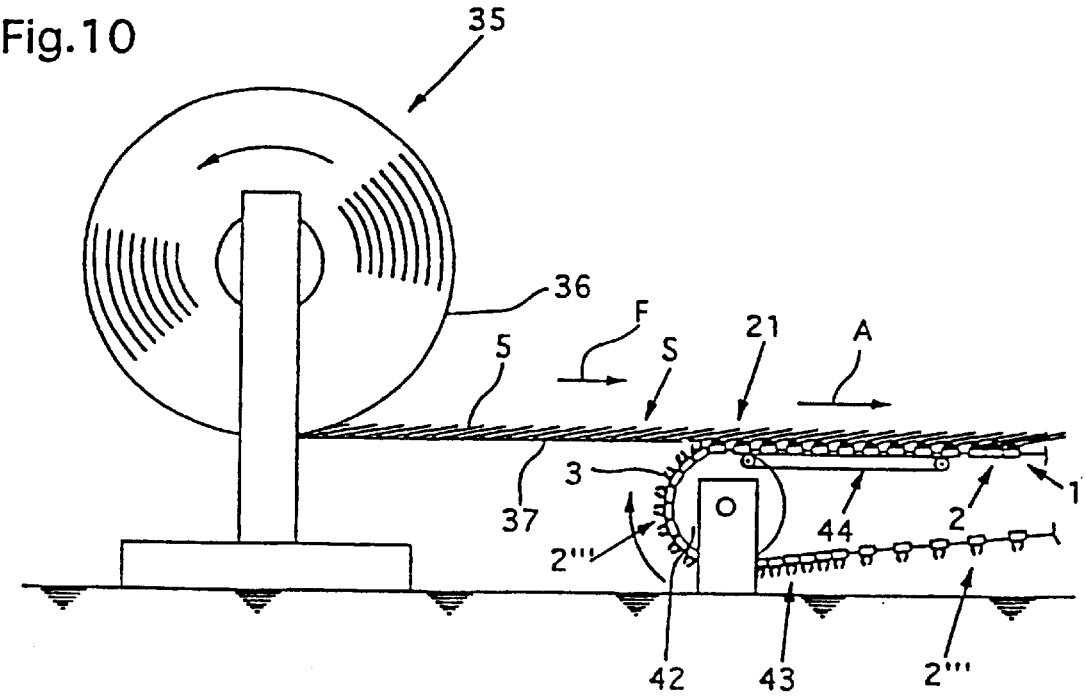
FIGS. 10 and 11 show other embodiments of the charging location of a conveying system of the type shown in FIG. 9.
Figure 11:
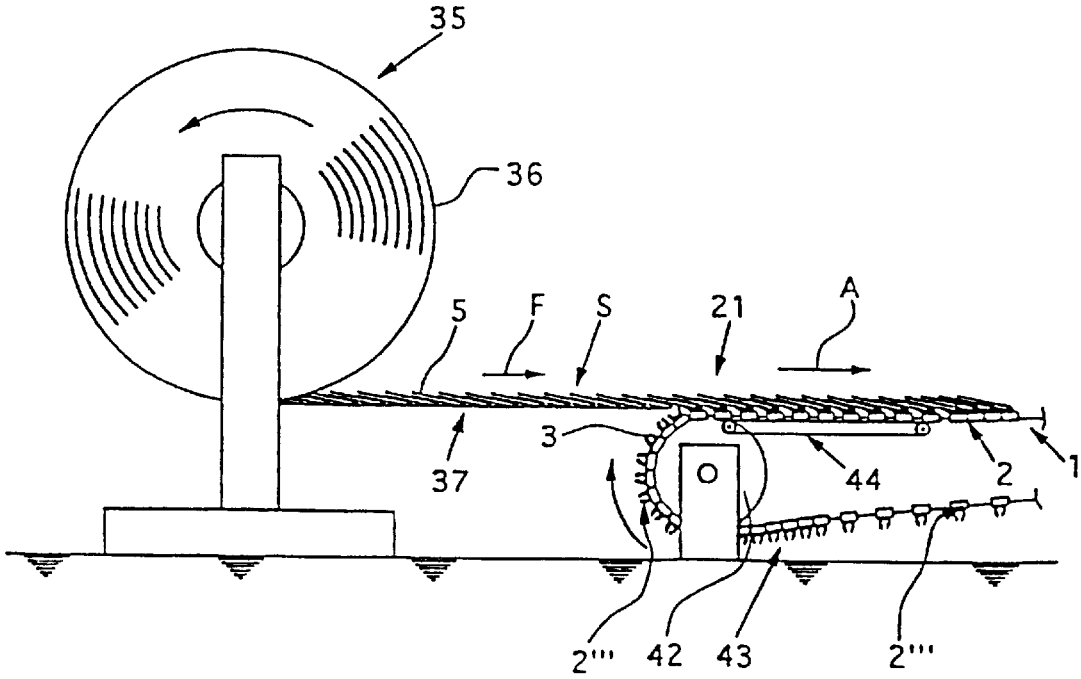

FIGS. 10 and 11 illustrate other embodiments of charging locations 21 of the conveying system of the type shown in FIG. 9. In the two embodiments, the conveying path 1 is routed differently in the region of the deflection wheel 42. That section of the conveying path 1 which adjoins the deflection wheel 42 runs approximately horizontally or in a slightly upwardly sloping manner (in contrast to the approximately vertically running section 39 in FIG. 9). In the receiving region, in which the grippers 3 of the transporting elements 2 grip the printed products 5 fed in imbricated formation S, there is a drive arrangement 44 for moving the transporting elements 2 at given spacings from one another.

In the variant according to FIG. 10, in each case one printed product 5 rests on the preceding printed product. The grippers 3 of the transporting elements 2 grip the printed products 5 at there bottom, trailing edge, which in the present case is the folded edge.

In the embodiment according to FIG. 11, the printed products 5 are in the same position, within the imbricated formation S, as in the embodiment according to FIG. 9, i.e. each printed product 5 rests on the following printed product. The grippers 3 grip the printed products 5 at their leading, bottom edge, which in this embodiment is the folded edge.

Figure 12:
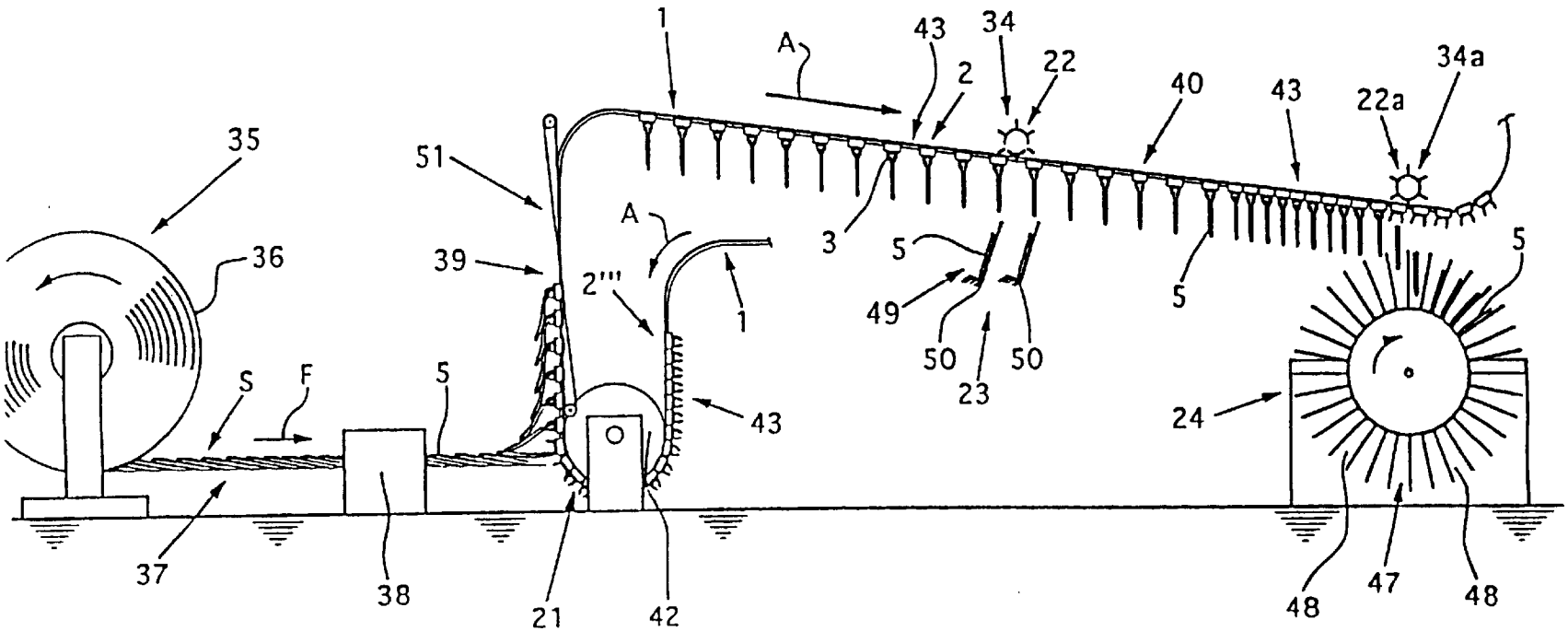
FIG. 12 shows part of a further embodiment of conveying system with a charging location and discharge locations.

FIG. 12 shows part of a further embodiment of a conveying system according to the invention with a main conveying path 1 designed as a closed loop. The branching locations and introduction locations are not illustrated in this case. Parts which correspond to one another have the same designations in FIG. 12 as in FIG. 9.

Two discharge locations 22 and 22*a*, which are each respectively assigned a processing station 23, 24, are also provided in the variant according to FIG. 12. Located in the processing station 24 is an insertion drum 47 (only illustrated schematically) which is of known design and is driven in rotation in the clockwise direction. The insertion drum 47 has radially running compartments 48 into which the printed products 5 released at the discharge location 22*a* drop. It goes without saying that it is also possible for the printed products 5 to be collated rather than inserted in the insertion drum 47.

Provided in the processing station 23 is an insertion device 49 which has stationery compartments 50 which receive printed products released by the grippers 3 of the transporting elements 2. It is also possible with this insertion device 49 for the printed products 5 to be collated rather than inserted. In order for the transporting elements 2 which are transporting the printed products 5 to be moved, after the charging location 21, along the upwardly sloping section 39 of the conveying path 1, a conveying and turning means 51 is provided, and, as the transporting elements 2 are conveyed upward, this means causes the transporting elements 2 to rotate through 180° about an axis running in the direction of the upwardly sloping section 39, in order that, in the downwardly sloping section 40 adjoining this upwardly sloping section 39, the printed products 5 are transported in a hanging position.

Figure 13:
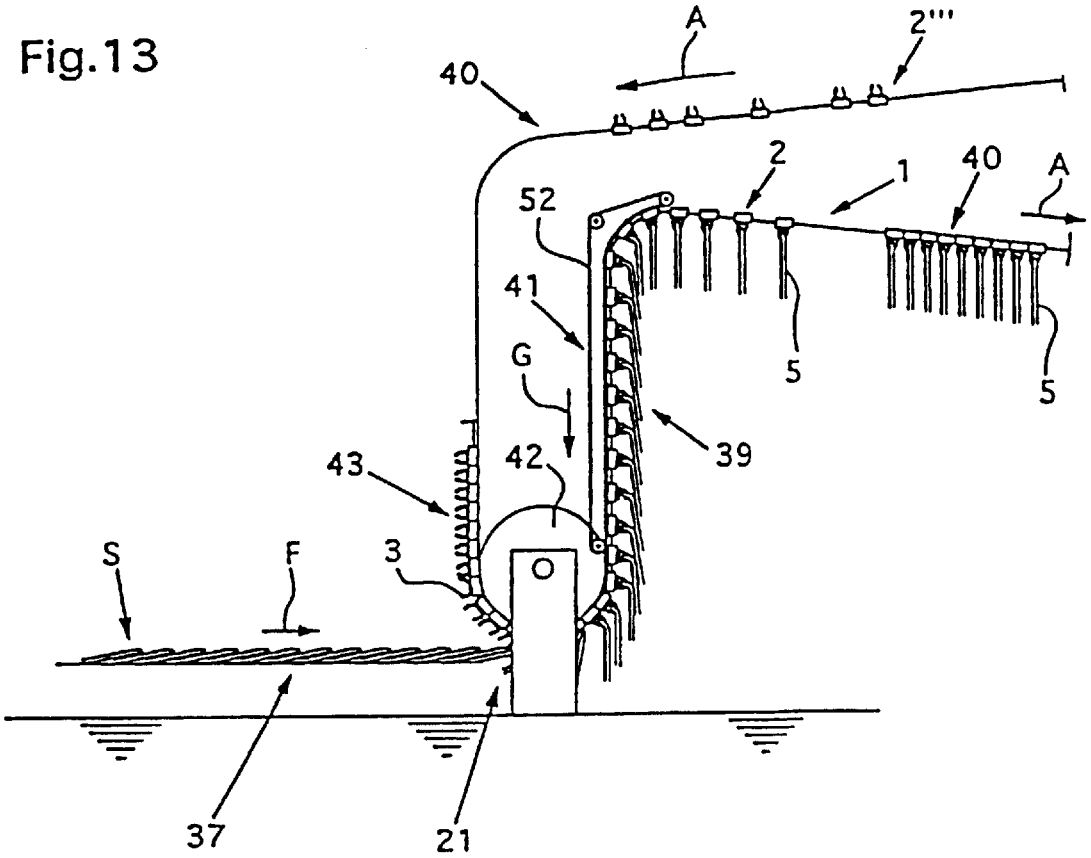
FIGS. 13 and 14 show part of a conveying system according to the invention with another embodiment of the charging location.
Figure 14:
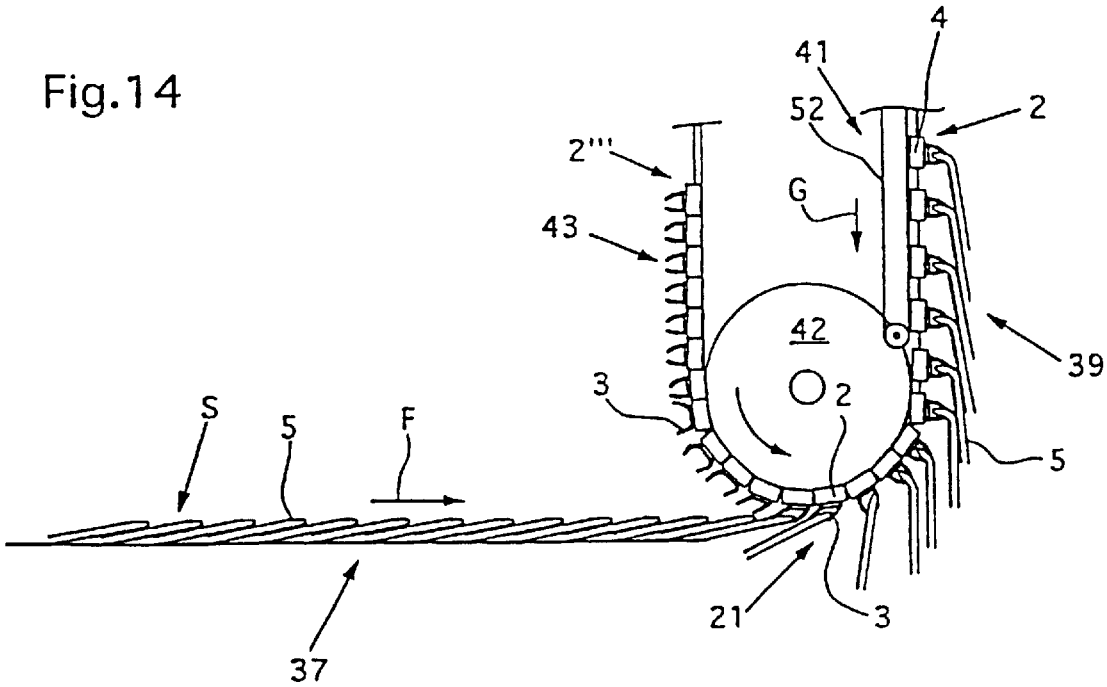

FIG. 13 shows the region of the charging location 21 of another embodiment of a conveying system according to the invention. FIG. 14 illustrates the product-receiving region on an enlarged scale. Components and elements which correspond to one another have the same designations as in the preceding figures.

The printed products are likewise fed in an imbricated formation S from a source (not illustrated) to the charging location 21. It is possible, but not absolutely necessary, for this source to be a product roll 36. In this imbricated formation S, each printed product 5 rests on the preceding printed product. The leading edge of the printed products 5 is located at the top in the imbricated formation S and is preferably the folded edge. The grippers 3 of the transporting elements 2 grip the printed products 5 at this top, leading edge. The transporting elements 2 are brought, by the deflection wheel 42 rotating in the counterclockwise direction, into the region of action of the conveying arrangement 52, which runs along the upwardly sloping section 39 of the conveying path 1 and circulates in the direction of the arrow G. By virtue of this conveying arrangement 52, the transporting elements 2 provided with printed products 5 are conveyed upward along the path section 39 and then passed to the downwardly sloping path 40, along which they are moved by the action of gravitational force.

The various exemplary embodiments explained above with reference to the figures demonstrate that the conveying system according to the invention has a first conveying path (main conveying path) 1 on which there are arranged

- a branching location 6 or more than one branching location 6, 6*a*, or
- an introduction location 12 or more than one introduction location 12, 12*a* or
- one or more branching locations 6 or 6, 6*a* and one or more introduction locations 12 or 12, 12*a*.

It is also possible for one or more charging locations 21 and/or one or more discharge locations 22, 22*a* to be arranged on the conveying path 1. The main conveying path 1 is preferably designed as a closed loop and, in a preferred embodiment, comprises upwardly sloping sections 39, 39*a* and downwardly sloping sections 40.

The following text refers to just a few of all the other possible variants which are not shown.

Instead of the grippers 3 of the transporting elements 2 being arranged on the carriages or slides 4 in a fixed manner, as is shown, it is also conceivable for the grippers 3 to be fastened on the carriages or slides 4 in a releasable manner and for devices which allow the grippers 3 to be released from the associated carriages or slides 4 to be provided at the discharge locations. In such an embodiment, the grippers then move along with the discharged articles.

Of course, it is also possible for the transporting elements 2 to be designed totally differently from those shown, depending on the type of articles which are to be transported. This is because instead of printed products, it is also possible for a conveying system according to the invention to convey any other suitable articles.

Instead of the printed products being fed from a product roll to the charging location, it is also possible for the printed products to be fed directly from the production system, e.g. the rotary printing machine, or from some other source, e.g. a stack.

What is claimed is:

1. A conveying system for conveying articles (5), comprising:

at least one conveying path (1);

a number of individual transporting elements (2) for transporting articles (5), said transporting elements (2) being independent from one another and movable along said conveying path (1);

at least one controllable branching location (6) or at least one controllable introduction location (12) arranged on the conveying path (1);

diverting means at said branching location (6) for diverting out of the conveying path (1) individual transporting elements (2) which are empty or are transporting articles (5); and introducing means at said introduction location (12) for introducing into the conveying path (1) individual transporting elements (2) which are empty or are transporting articles (5).

2. The conveying system as claimed in claim 1, wherein, at least one branching location (6) and at least one introduction location (12) are arranged on the conveying path (1).

3. The conveying system as claimed in claim 1 or 2, wherein at least one charging location (21) for transferring articles (5) to the transporting elements (2) is provided on the conveying path (1).

4. The conveying system as claimed in claim 1 or 2, wherein at least one discharge location (22) for discharging the articles (5) by way of the transporting elements (2) is provided on the conveying path (1).

5. The conveying system as claimed in claim 1 or 2, wherein the conveying path (1) is designed as a closed loop.

6. The conveying system as claimed in claim 4 wherein each discharge location (22) is assigned a processing station (23, 24).

7. The conveying system as claimed in claim 4, wherein each discharge location (22) is assigned a timing device (34) which causes the transporting elements (2) to be fed to the discharge location (22) in a specific timed sequence.

8. The conveying system as claimed in claim 4, wherein arranged upstream of each discharge location (22) is a storage path (43) along which the transporting elements (2) are stored.

9. The conveying system as claimed in claim 1 or 2, wherein the conveying path (1) has downwardly sloping sections (40) along which the transporting elements (2) are moved preferably under the action of gravitational force.

10. The conveying system as claimed in claim 1 or 2, wherein the conveying section (1) has upwardly sloping sections **(39, 39*a*) along which the transporting elements (2) are moved by conveying means (41, 51, 52)**.

11. The conveying system as claimed in claim 9 wherein the conveying path (1) has both downwardly sloping and upwardly sloping sections **(40; 39, 39*a*), and wherein a storage path (43) along which the transporting elements (2) are stored is provided in the transition from a downwardly sloping section (40) to an adjoining upwardly sloping section (39, 39*a*)**.

12. The conveying system as claimed in claim 1 or 2, wherein provided at each branching location **(6, 6*a*) and at each introduction location (12, 12*a*) are switchover diverters (7) for the connection of the conveying path (1) to a second conveying path (10) for guiding away the diverted transporting elements (2) and/or for the connection of the conveying path (1) to a third conveying path (16) for introducing transporting elements (2) which are conveyed along the third conveying path (16) into the conveying path (1)**.

13. The conveying system as claimed in claim 12, wherein arranged upstream of the diverter (7), as seen in the respective conveying direction (A, C) of the first and the third conveying paths (1, 16), is a controllable restraining element (11, 19; 17) which can be displaced into the movement path of the transporting elements (2) in order to stop the transporting elements (2).

14. The conveying system as claimed in claim 1 or 2, wherein the transporting elements (2) have controllable grippers (3) for gripping the articles (5) which are to be transported, said grippers being connected to carriages or slides (4) in a fixed or releasable manner.

15. The conveying system as claimed in claim 1 or 2 for conveying printed products (5) which occur in a printed-product-processing plant.

16. The conveying system as claimed in claim 5, wherein each discharge location (22) is assigned a processing station (23, 24).

17. The conveying system as claimed in claim 7, wherein arranged upstream of each discharge location (22) is a storage path (43) along which the transporting elements (2) are stored.

18. The conveying system as claimed in claim 3, wherein the conveying path (1) has downwardly sloping sections (40) along which the transporting elements (2) are moved preferably under the action of gravitational force.

19. The conveying system as claimed in claim 3, wherein the conveying section (1) has upwardly sloping sections **(39, 39*a*) along which the transporting elements (2) are moved by conveying means (41, 51, 52)**.

20. The conveying system as claimed in claim 18, wherein the conveying path (1) has both downwardly sloping and upwardly sloping sections **(40, 39, 39*a*), and wherein a storage path (43) along which the transporting elements (2) are stored is provided in the transition from a downwardly sloping section (40) to an adjoining upwardly sloping section (39, 39*a*)**.

21. The conveying system as claimed in claim 19, wherein the conveying path (1) has both downwardly sloping and upwardly sloping sections **(40, 39, 39*a*), and wherein a storage path (43) along which the transporting elements (2) are stored is provided in the transition from a downwardly sloping section (40) to an adjoining upwardly sloping section (39, 39*a*)**.

22. The conveying system as claimed in claim 3, wherein provided at each branching location **(6, 6*a*) and at each introduction location (12, 12*a*) are switchover diverters (7) for the connection of the conveying path (1) to a second conveying path (10) for guiding away the diverted transporting elements (2) and/or for the connection of the conveying path (1) to a third conveying path (16) for introducing transporting elements (2) which are conveyed along the third conveying path (16) into the conveying path (1)**.

23. The conveying system as claimed in claim 22, wherein arranged upstream of the diverter (7), as seen in the respective conveying direction (A, C) of the first and the third conveying paths (1, 16), is a controllable restraining element (11, 19, 17) which can be displaced into the movement path of the transporting elements (2) in order to stop the transporting elements (2).

24. The conveying system as claimed in claim 3, wherein the transporting elements (2) have controllable grippers (3) for gripping the articles (5) which are to be transported, said grippers being connected to carriages or slides (4) in a fixed or releasable manner.

25. The conveying system as claimed in claim 3 for conveying printed articles which occur in a printed-product-processing plant.

* * * * *